US010508425B2

(12) United States Patent
Owen

(10) Patent No.: US 10,508,425 B2
(45) Date of Patent: Dec. 17, 2019

(54) OVERFLOW VENT IRRIGATION DEVICE

(71) Applicant: Wesley Owen, Albuquerque, NM (US)

(72) Inventor: Wesley Owen, Albuquerque, NM (US)

( * ) Notice: Subject to any disclaimer, the term of this patent is extended or adjusted under 35 U.S.C. 154(b) by 0 days.

(21) Appl. No.: 15/937,483

(22) Filed: Mar. 27, 2018

(65) Prior Publication Data

US 2018/0305911 A1 Oct. 25, 2018

Related U.S. Application Data

(60) Provisional application No. 62/487,841, filed on Apr. 20, 2017.

(51) Int. Cl.

| | |
|---|---|
| ***E03C 1/306*** | (2006.01) |
| ***E03C 1/24*** | (2006.01) |
| ***B01F 1/00*** | (2006.01) |
| ***B08B 9/00*** | (2006.01) |
| *B08B 9/027* | (2006.01) |

(52) U.S. Cl.

CPC ..... *E03C 1/24* (2013.01); *B01F 1/0027* (2013.01); *B08B 9/00* (2013.01); *E03C 1/306* (2013.01); *B08B 9/027* (2013.01)

(58) Field of Classification Search

CPC ... B08B 9/032–0321; B08B 2203/0217; E03C 1/126; E03C 1/244; E03C 1/30–308

USPC ..... 4/226.1

See application file for complete search history.

(56) References Cited

U.S. PATENT DOCUMENTS 977,005 A * 11/1910 Haddock ..... E03C 1/306 134/93
1,745,010 A * 1/1930 De Lamprecht ..... E03D 9/031 4/226.1
2,009,398 A 7/1935 Green
2,137,300 A * 11/1938 Allen ..... B08B 9/0321 137/574
2,315,673 A * 4/1943 Taylor ..... E03C 1/306 4/255.01
2,430,976 A * 11/1947 Dutra ..... E03C 1/306 134/7
4,321,712 A * 3/1982 Dixon ..... E03C 1/06 4/255.01
D283,725 S 5/1986 Mahoney
5,028,077 A * 7/1991 Hurst ..... F16L 27/107 285/252
5,209,262 A 5/1993 Carow et al.
5,253,664 A 10/1993 Wilson
D357,307 S 4/1995 Ramacier, Jr. et al.

(Continued)

FOREIGN PATENT DOCUMENTS

WO WO 2010002924 A2 1/2010

*Primary Examiner* — Erin Deery
*Assistant Examiner* — Nicholas A Ros
(74) *Attorney, Agent, or Firm* — Trenner Law Firm, LLC; Mark D. Trenner

(57) ABSTRACT

An overflow vent irrigation device is disclosed. An example overflow vent irrigation device includes a reservoir body having an input port and an exit port. The example overflow vent irrigation device also includes a tablet chamber in fluid communication with the reservoir body, and a turbulence dam within the reservoir body. The input port is connected to a faucet of a basin, and the exit port is connected via a hose to an overflow port of an overflow-to-drain journal of the basin during use to clean the overflow journal of the basin.

15 Claims, 16 Drawing Sheets

(56) References Cited

U.S. PATENT DOCUMENTS

| | | | | |
|---|---|---|---|---|
| 5,890,517 | A | 4/1999 | Laible | |
| D426,617 | S | 6/2000 | Hansen | |
| 6,688,542 | B1 | 2/2004 | Hoffmeier | |
| 6,941,589 | B1 | 9/2005 | Dural et al. | |
| 7,063,095 | B2 * | 6/2006 | Barcay | B08B 9/00 134/166 R |
| D554,238 | S | 10/2007 | Zielke et al. | |
| D657,849 | S | 4/2012 | Cardo | |
| D678,484 | S | 3/2013 | Dietterle et al. | |
| 9,322,154 | B2 | 4/2016 | Beaumont | |
| D755,354 | S | 5/2016 | Coronado | |
| 9,359,751 | B2 * | 6/2016 | Beaumont | E03D 9/00 |
| 2007/0035126 | A1 | 2/2007 | Hickey et al. | |
| 2011/0083707 | A1 * | 4/2011 | Beltran | E03C 1/306 134/198 |
| 2012/0161051 | A1 | 6/2012 | Williams et al. | |
| 2015/0159354 | A1 | 6/2015 | Laera | |
| 2015/0345123 | A1 * | 12/2015 | Grover | E03D 9/031 4/226.1 |
| 2018/0347163 | A1 * | 12/2018 | Tolman | E03C 1/306 |

* cited by examiner

OVERFLOW VENT IRRIGATION DEVICE

CROSS REFERENCE TO RELATED APPLICATIONS

This application claims the priority benefit of U.S. Provisional Patent Application No. 62/487,841 filed Apr. 20, 2017 for "Overflow Vent Irrigation Device," hereby incorporated by reference in its entirety as though fully set forth herein.

BACKGROUND

Most sinks have an overflow vent to catch rising water and divert it to the drain before the sink overflows. Unfortunately, water that gets into the overflow vent may not fully drain, allowing bacteria to grow in the overflow vent. When water passes through the drain during normal use, air may be forced through the overflow vent past this bacteria and out into the air around the sink. This can become a health risk, particularly in public-use sinks such as public restrooms, hospitals, and other sinks that may harbor harmful bacteria.

BRIEF DESCRIPTION OF THE DRAWINGS

FIGS. 9-10 illustrate example operation, wherein FIG. 9 is a right-side view of the device shown as it may be installed in a basin such as sink, the sink shown as a cut-away view; and FIG. 10 is a overview of the overflow vent irrigation system in the functional configuration installed in a standard fixture.

DETAILED DESCRIPTION

An overflow vent irrigation device is disclosed. In an example, the device includes a faucet snap fitting or other connection to connect to a faucet manifold, and is designed to inject a cleaning fluid into the overflow vent of residential and commercial basin (e.g., sink, tub, etc.) to clean and disinfect the overflow-to-drain journal. In an example, the device takes advantage of water pressure generated by the device to dissolve a cleaning tablet, mix the cleaner with water, and deliver the mixture to the overflow vent of the basin.

In an example, the device includes a reservoir (e.g., constructed of molded plastic, cast or machined metal). The reservoir may have a tablet chamber, an internal manifold designed to increase water velocity, and a hose connection. The example device may also include a flexible hose, second hose connection, splash guard, and injection nozzle. The example overflow vent irrigation device provides a turbulence dam within the reservoir body.

During use, the input port is connected to a faucet of a basin such as a sink, and the exit port is connected via a hose to an overflow port of the overflow-to-drain journal of the sink. In an example, the device can be implemented to clean and disinfect the overflow-to-drain journals, with a pressurized cleaning fluid. The device may be readily manufacturable at low cost, and may be easily portable from one sink or fixture to another, and from one location to another.

Before continuing, it is noted that as used herein, the terms "includes" and "including" mean, but is not limited to, "includes" or "including" and "includes at least" or "including at least." The term "based on" means "based on" and "based at least in part on." In addition, the term "sink" is used herein generally to refer to any basin having an overflow-to-drain journal.

It is also noted that the examples described herein are provided for purposes of illustration, and are not intended to be limiting. Other devices and/or device configurations may be utilized to carry out the operations described herein. Although components are shown with particular shapes, dimensions, and orientations, it should be understood that a wide variety of different shapes, dimensions, and orientations may be employed to achieve the desired effect, and that components may be arranged in different orders or configurations such that operations of the overflow vent irrigation device occur in different order to achieve the desired effect. Some components may be deleted or replaced with analogous components while still allowing the device to achieve the desired effect, and a variety of additional components may be added that do not interfere with the desired operation or operations of the device. Still other examples are also contemplated.

Figure 1:
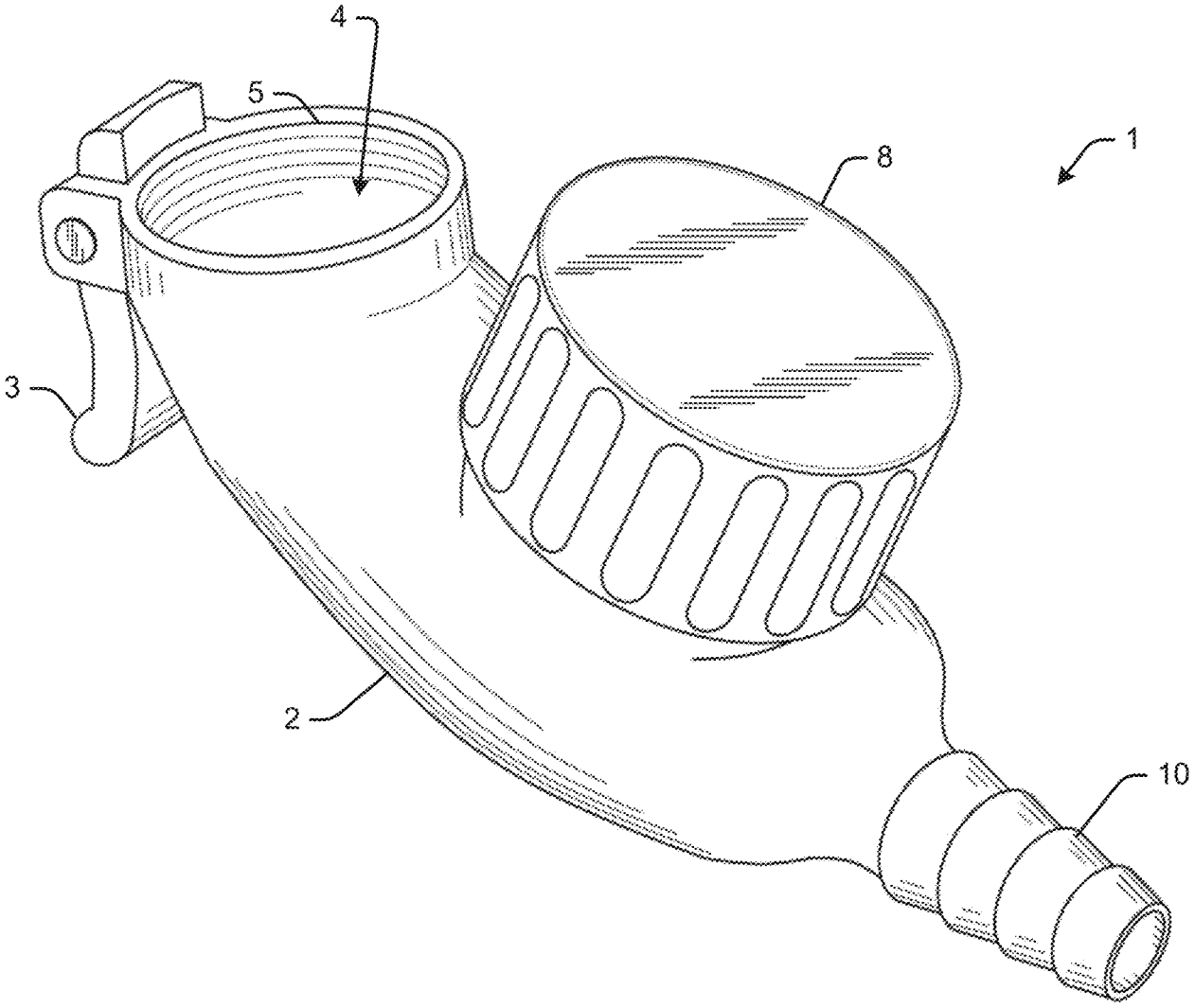
FIG. 1 is a top perspective view of an example overflow vent irrigation device.
Figure 2:
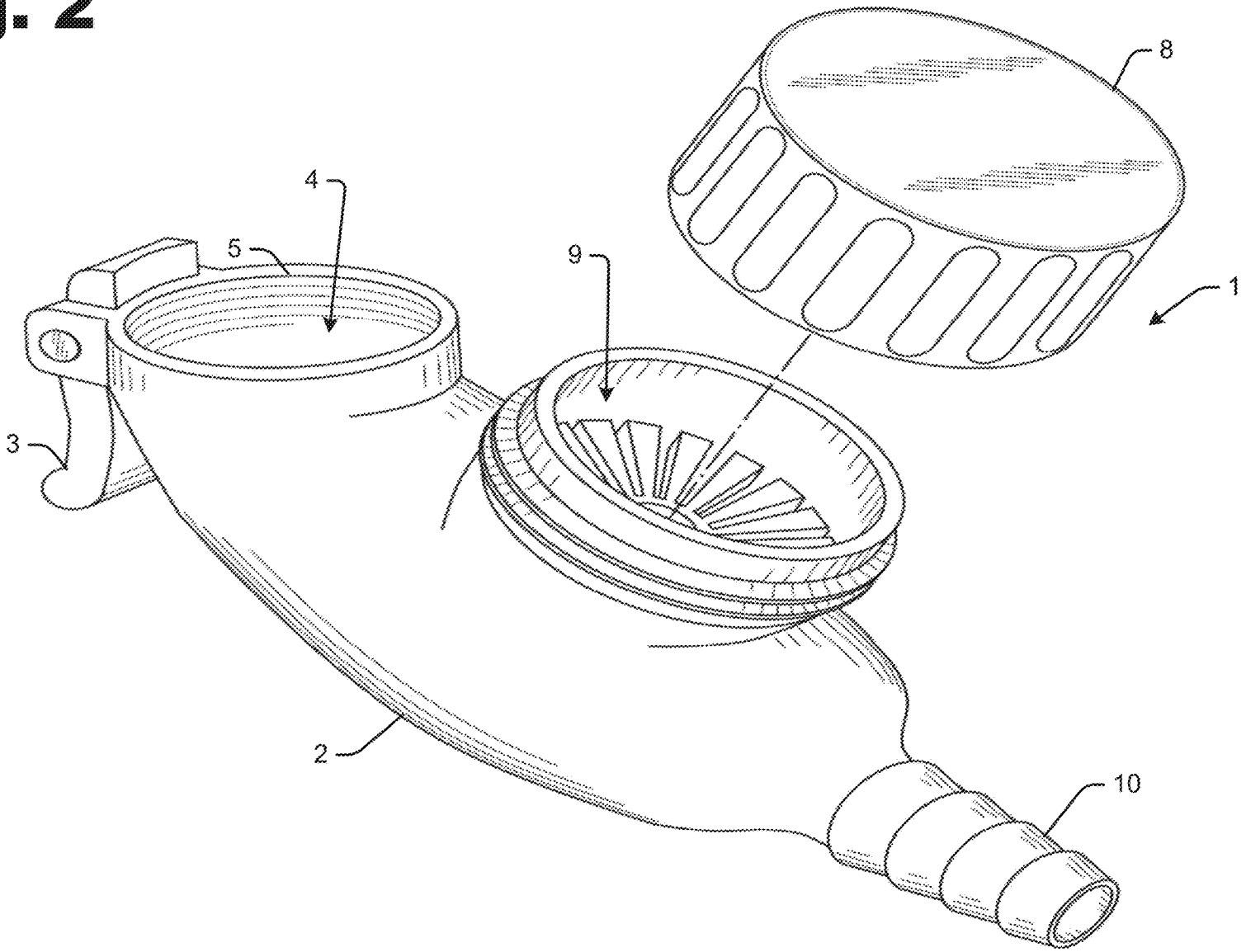
FIG. 2 is a top perspective view of the example overflow vent irrigation device.

FIG. 1 is a top perspective view of an example overflow vent irrigation device 1. FIG. 2 is a top perspective view of the example overflow vent irrigation device 1 with the tablet chamber cap 8 removed, to show the interior of the tablet chamber 9.

In an example, the device 1 includes a reservoir 2 with a tablet chamber 9. A quick connect retaining clip 3 is provided to attach a faucet manifold 5 to a faucet or faucet connector. Other connectors are also contemplated, including but not limited to clips, keepers, slide-locks, and screw-on attachments. During operation, water may flow through an internal manifold 4 within the reservoir 2, and exit through a hose connector 10. A tablet may be enclosed in the tablet chamber 9 such that the tablet dissolves into the flow through the reservoir's internal manifold 4, affecting the composition of the water exiting through the hose connector 10.

Figure 3:
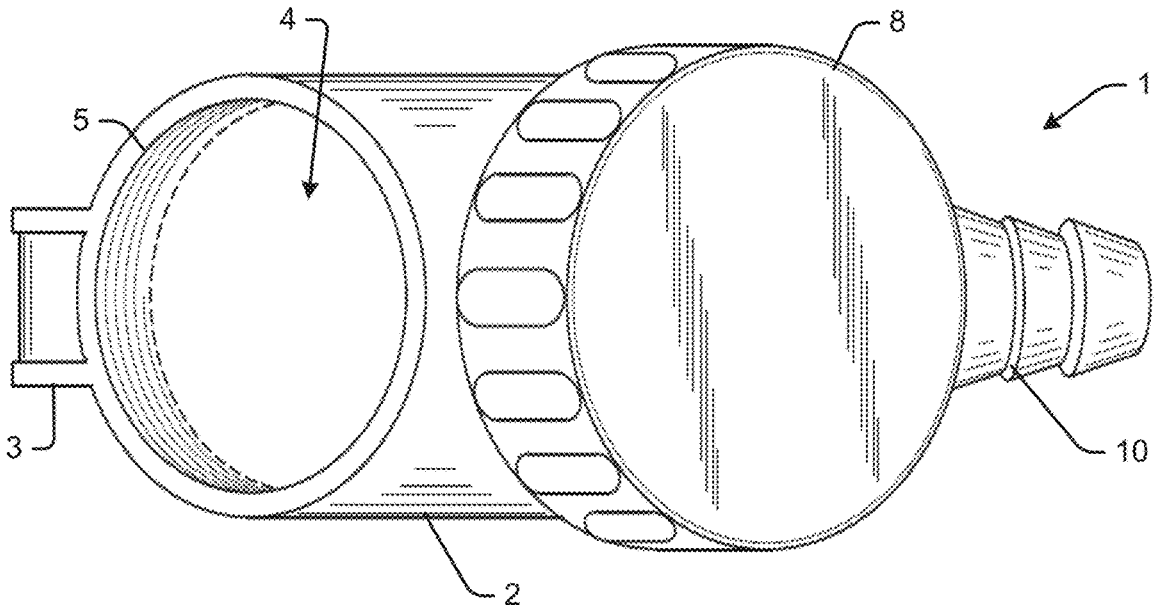
FIG. 3 is a top view of the example overflow vent irrigation device.
Figure 4:
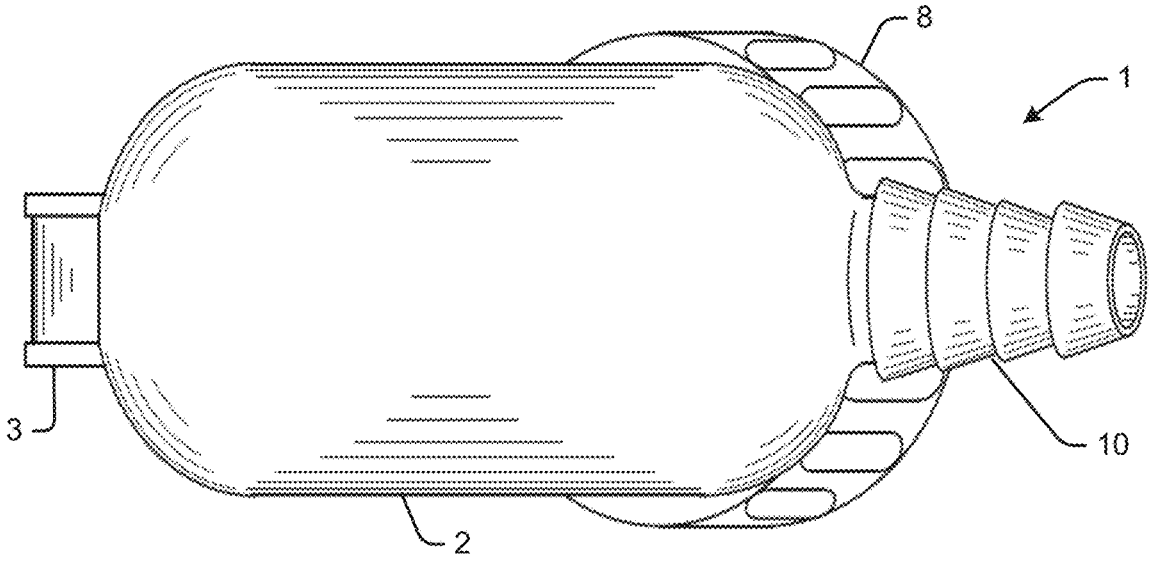
FIG. 4 is a bottom view of the example overflow vent irrigation device.
Figure 5:
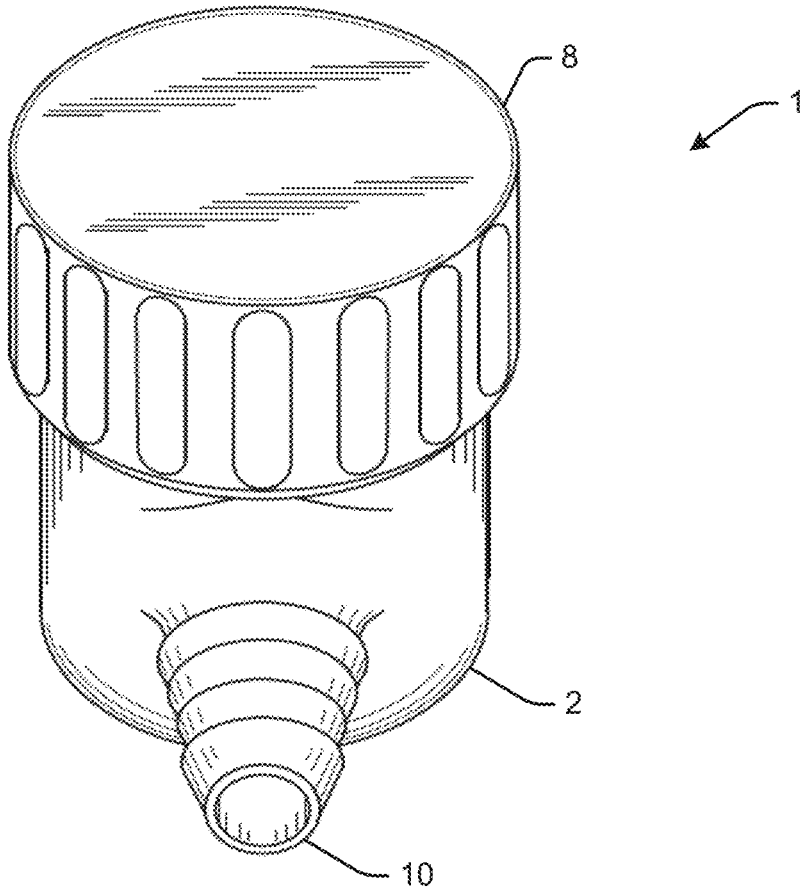
FIG. 5 is a front view of the example overflow vent irrigation device.
Figure 6:
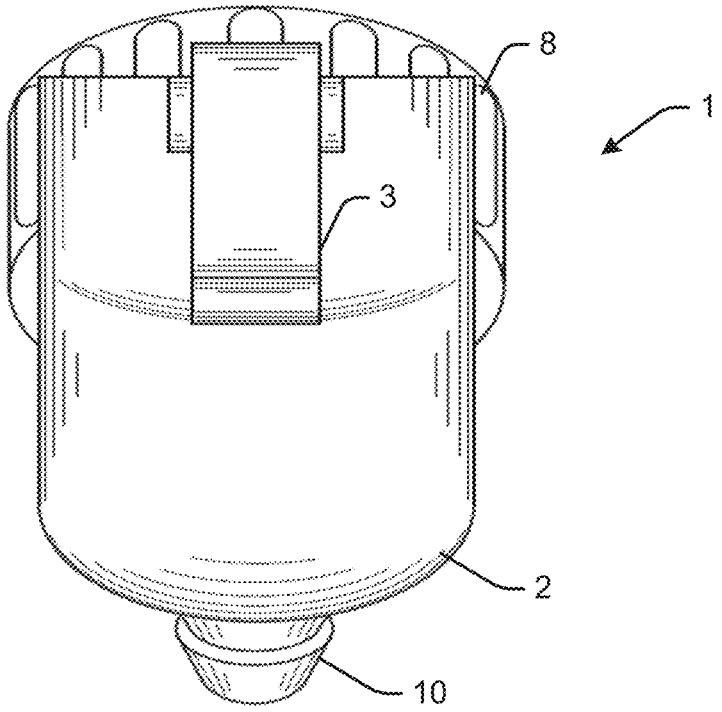
FIG. 6 is a back view of the example overflow vent irrigation device.

FIG. 3 is a top view of the example overflow vent irrigation device 1 with the tablet chamber cap 8 attached to the tablet chamber 9. FIG. 4 is a bottom view of the example overflow vent irrigation device 1 with the tablet chamber cap 8 attached. FIG. 5 is a front view of the example overflow vent irrigation device 1 with the tablet chamber cap 8 attached. FIG. 6 is a back view of the example overflow vent irrigation device 1 with the tablet chamber cap 8 attached.

The quick connect retaining clip 3 can be seen adjacent to the faucet manifold 5 (through which water enters the reservoir 2). The quick connect clip 3, the tablet chamber cap 8, and the hose connect 10 are shown.

Figure 7:
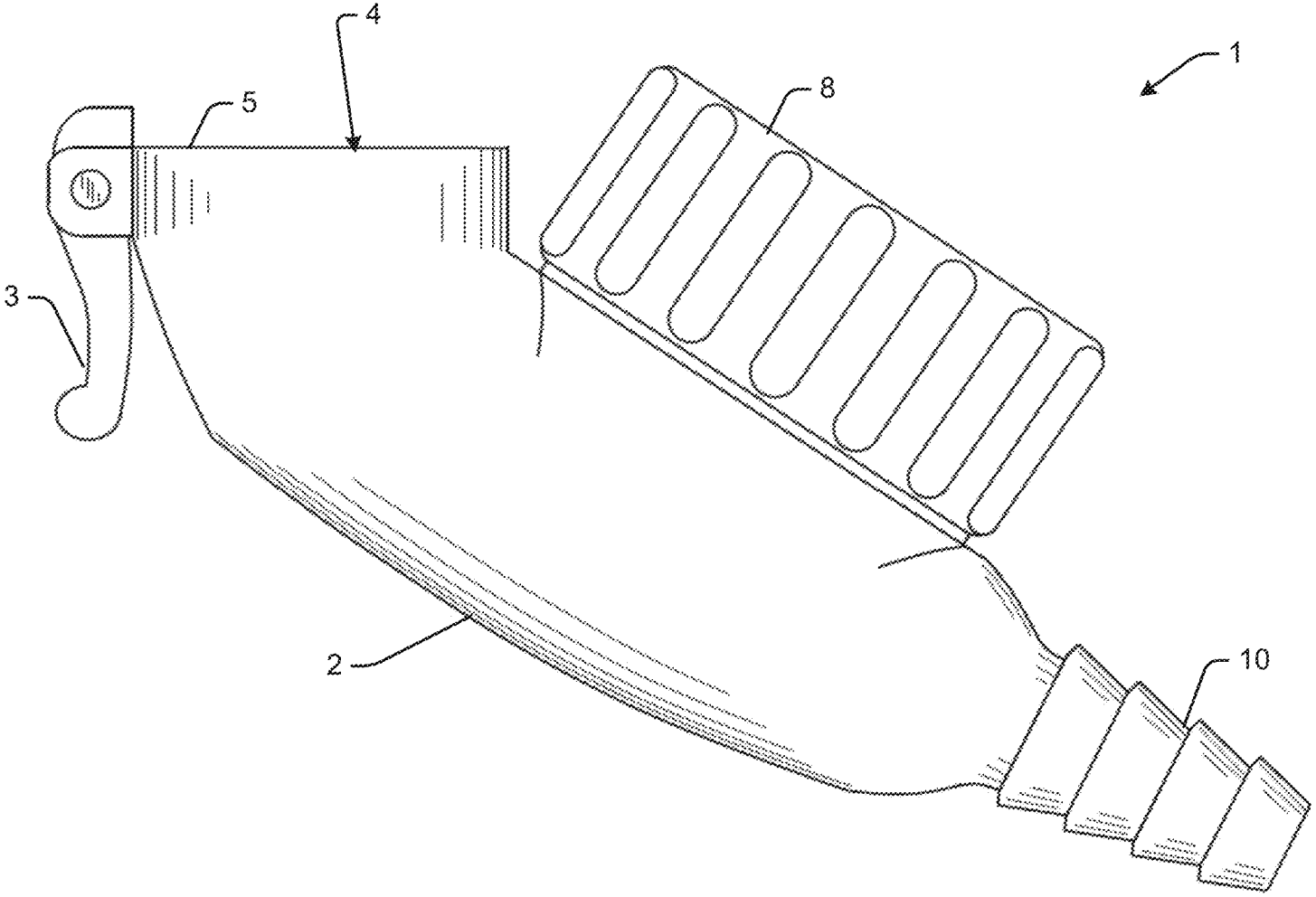
FIG. 7 is a right-side view of the example overflow vent irrigation device.
Figure 8:
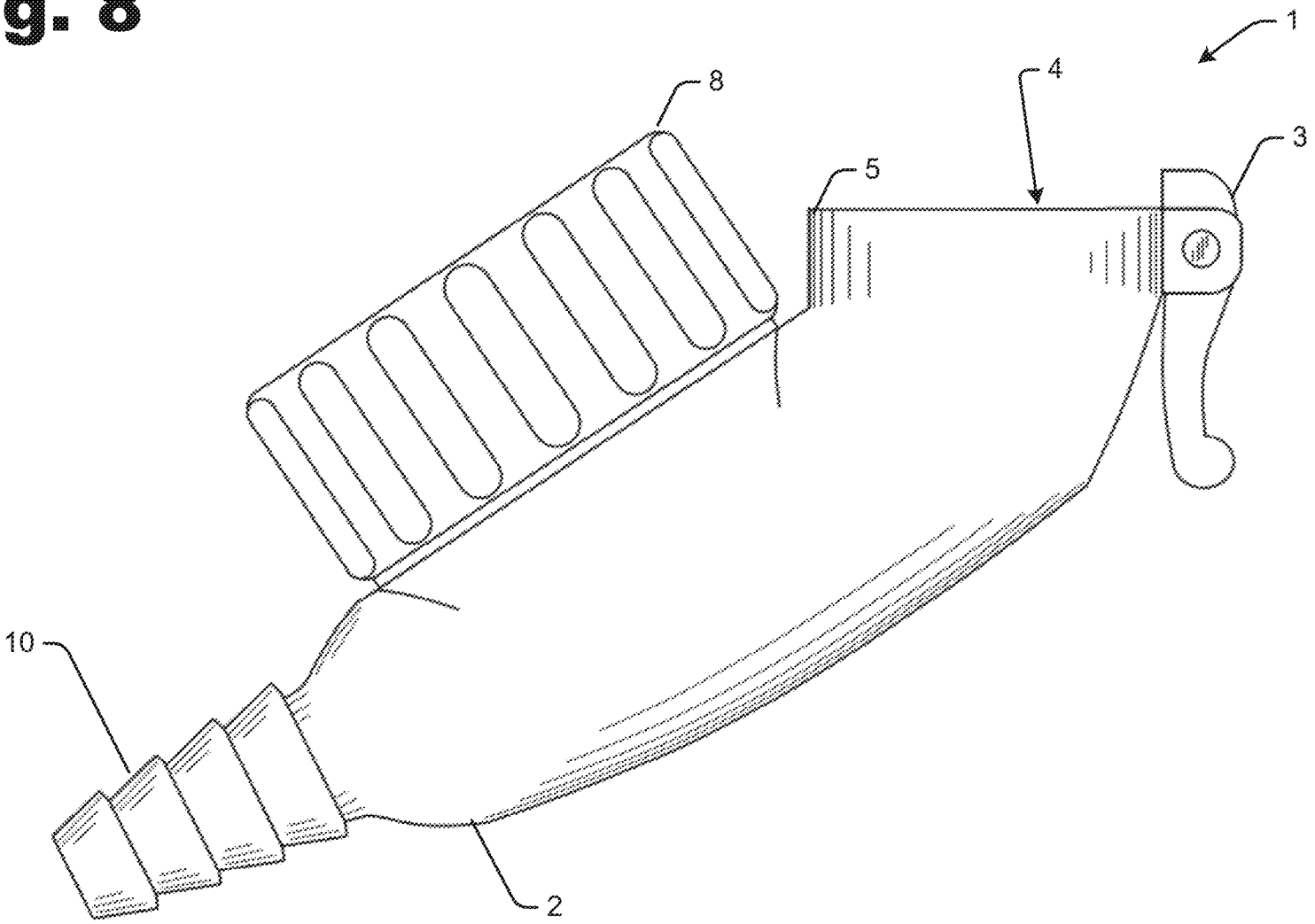
FIG. 8 is left-side view of the example overflow vent irrigation device.

FIG. 7 is a right-side view of the example overflow vent irrigation device 1 with the tablet chamber cap 8 attached. FIG. 8 is left-side view of the example overflow vent irrigation device 1 with the tablet chamber cap 8 attached. The faucet manifold 5 connects to a faucet and is held in place by the quick connect retaining clip 3, such that water may travel into the internal manifold 4, travel through and adjacent to the tablet chamber 9, and exit through the hose connector 10.

Water flow from the faucet of the basin (e.g., a sink) enters the reservoir 2 and exits the reservoir through the hose connect 10. In an example, the water flow may dissolve and/or retrain some or all of a cleaning material from a tablet in the tablet chamber 9. The water flow with cleaning material exits the reservoir 2 (e.g., carrying the dissolved or suspended material) through the hose connect 10. Operation can be better understood with reference to FIGS. 9-10.

Figure 9:
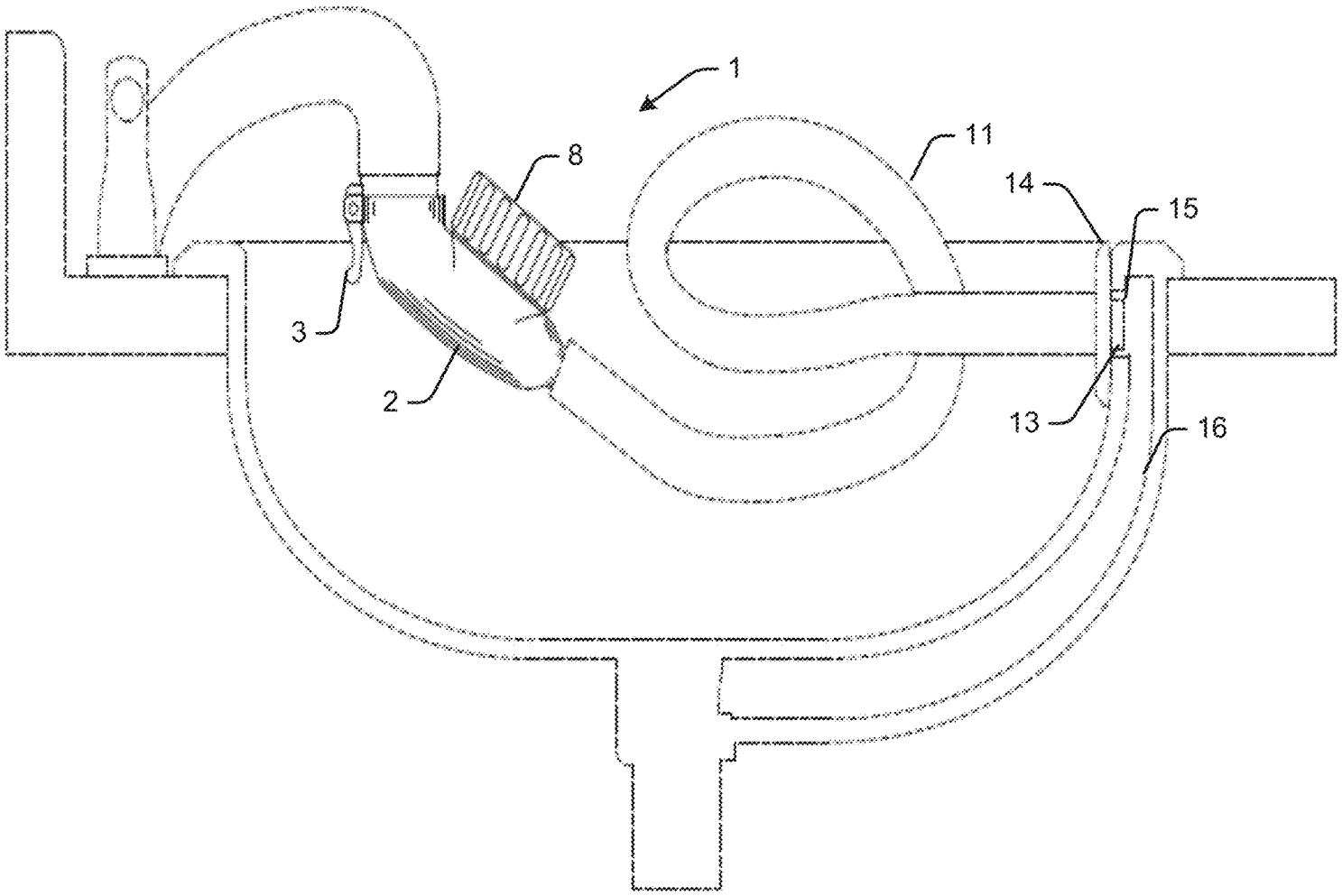
Figure 10:
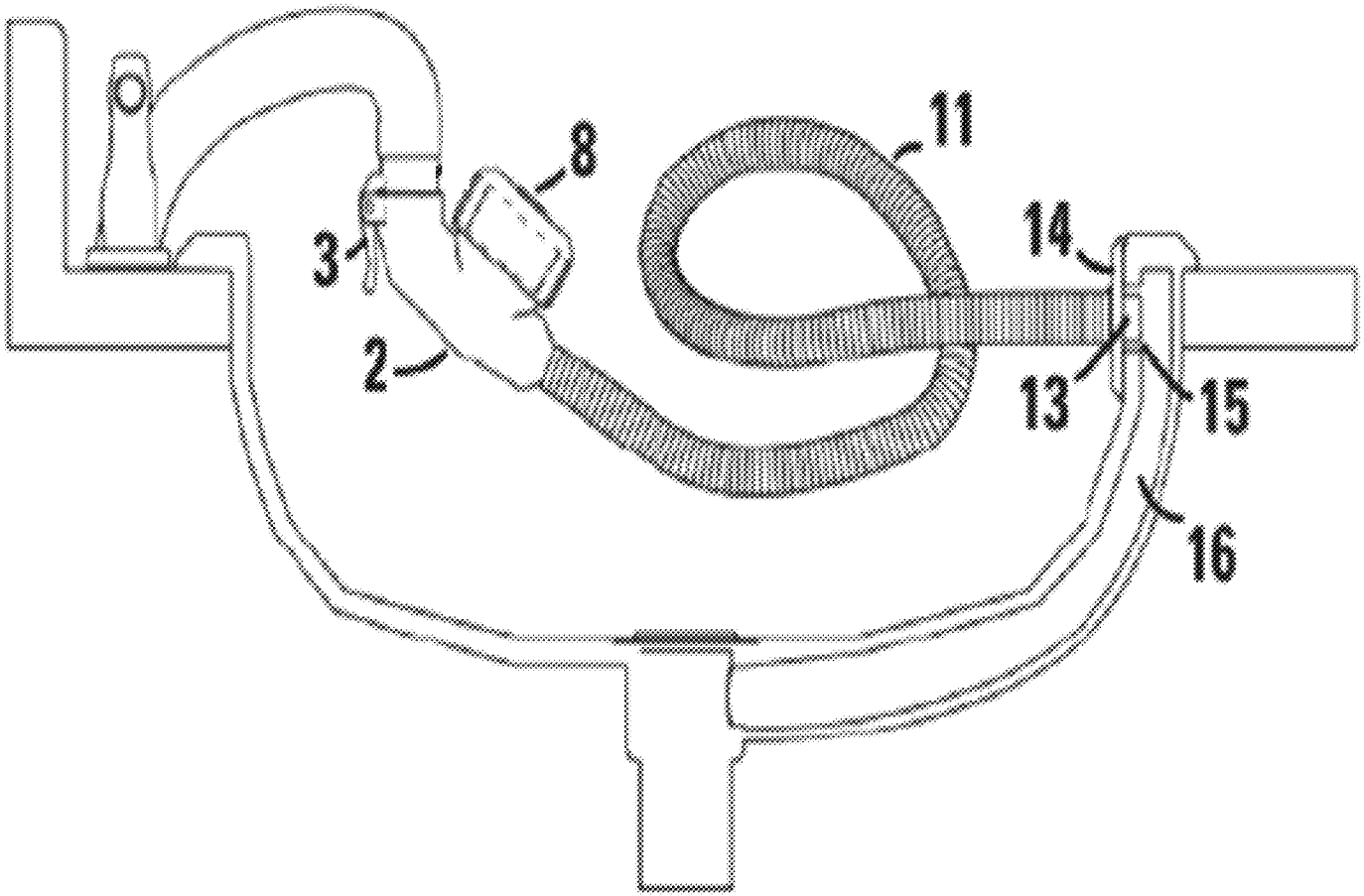

FIGS. 9-10 illustrate example operation of the device 1. FIG. 9 is a right-side view of the device 1 shown as it may be installed in a basin such as a sink. The sink and faucet are shown as a cut-away view in dashed lines. FIG. 10 also shows the overflow vent irrigation device 1 as it may be installed in a standard residential or commercial sink. In an example, the overflow vent irrigation device 1 may include a hose, and an injection nozzle and splash shield to connect the hose to the overflow port of the overflow-to-drain journal of the sink.

In an example, a reservoir body 2 is connected to a faucet manifold 5 (e.g., having a NEOPERL brand replacement aerator part #591194). The faucet manifold 5 may be attached to the faucet of the sink by a snap fitting (e.g., quick connect retaining clip 3) on the faucet manifold 5.

The reservoir 2 is shown as it may be connected via a flexible hose 11 to an injection nozzle 13. A splash shield 14 is also shown holding the injection nozzle 13 into overflow port 15 of the fixture. The overflow port 15 is shown leading to an overflow-to-drain journal 16 of the fixture.

In this configuration, water from the sink faucet passes through the faucet manifold 5 and into the reservoir 2, where it may come in contact with a cleaning tablet in the tablet chamber 9. The water flow then exits the reservoir 2 via host connect 10 into the hose 11, passes through the injection nozzle 13 and into the overflow port 15 of the overflow-to-drain journal of the sink. The water flow thus may pass through the overflow-to-drain journal 16 and dislodge or dissolve foreign material and carry it into the drain of the sink. The cleaning agent may also kill or dislodge organisms resident in the overflow-to-drain journal 16, thus cleaning and disinfecting the overflow-to-drain journal 16.

The operations shown and described herein with reference to FIGS. 9 and 10 are provided to illustrate example implementations. It is noted that the operations are not limited to the ordering shown. Still other operations may also be implemented. In an example, the overflow vent irrigation device 1 may include an erosion manifold and/or a turbulence dam in the reservoir body.

Figure 11:
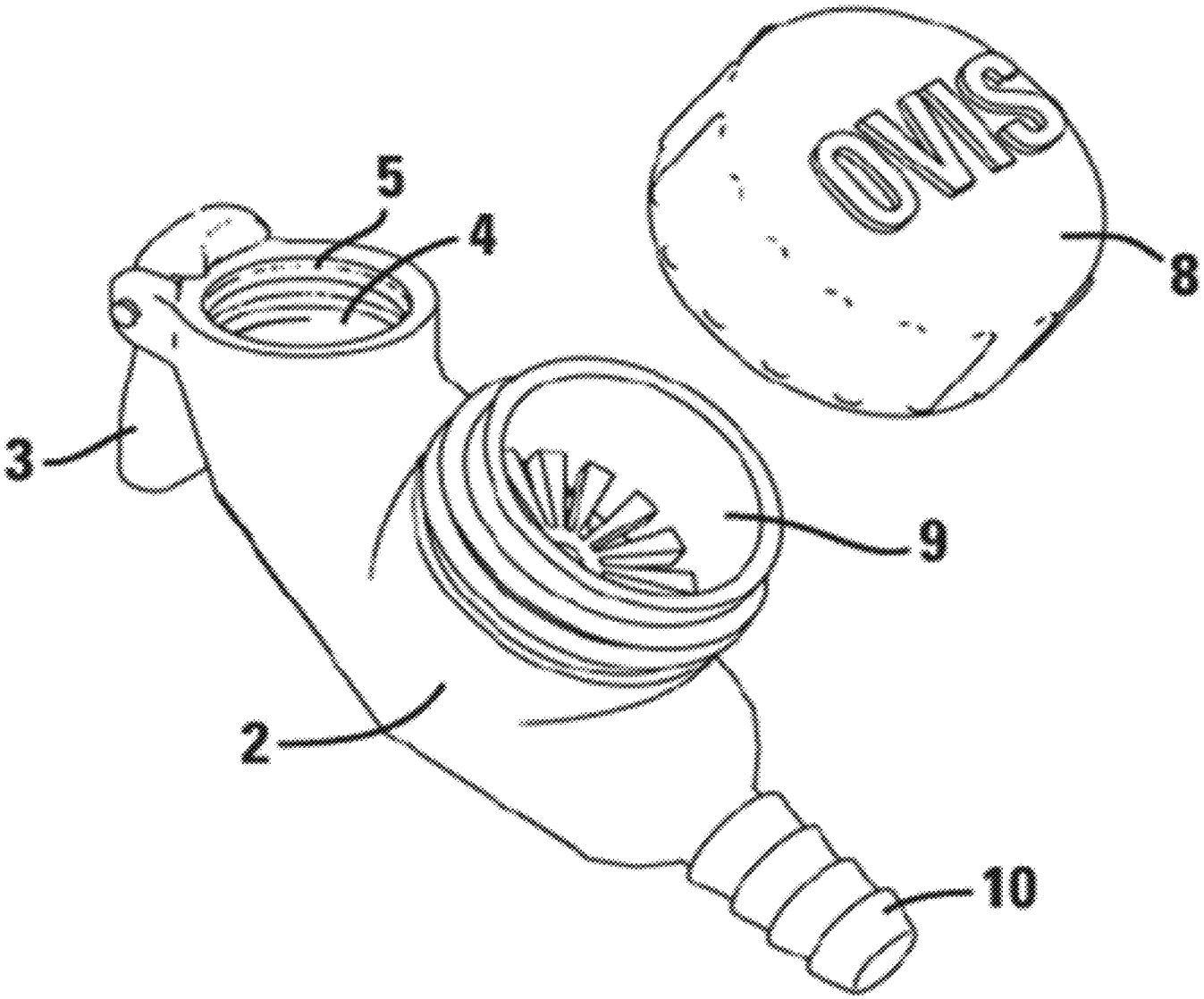
FIG. 11 is an overview of example reservoir components.

FIG. 11 is another example of the device 1 including a reservoir body 2, quick connect retaining clip 3, reservoir bore or internal manifold 4, bore seal or faucet manifold 5, tablet chamber cap 8, tablet chamber 9, and flex hose fitting 10. In this example, the tablet chamber cap 8 includes a logo.

Figure 12:
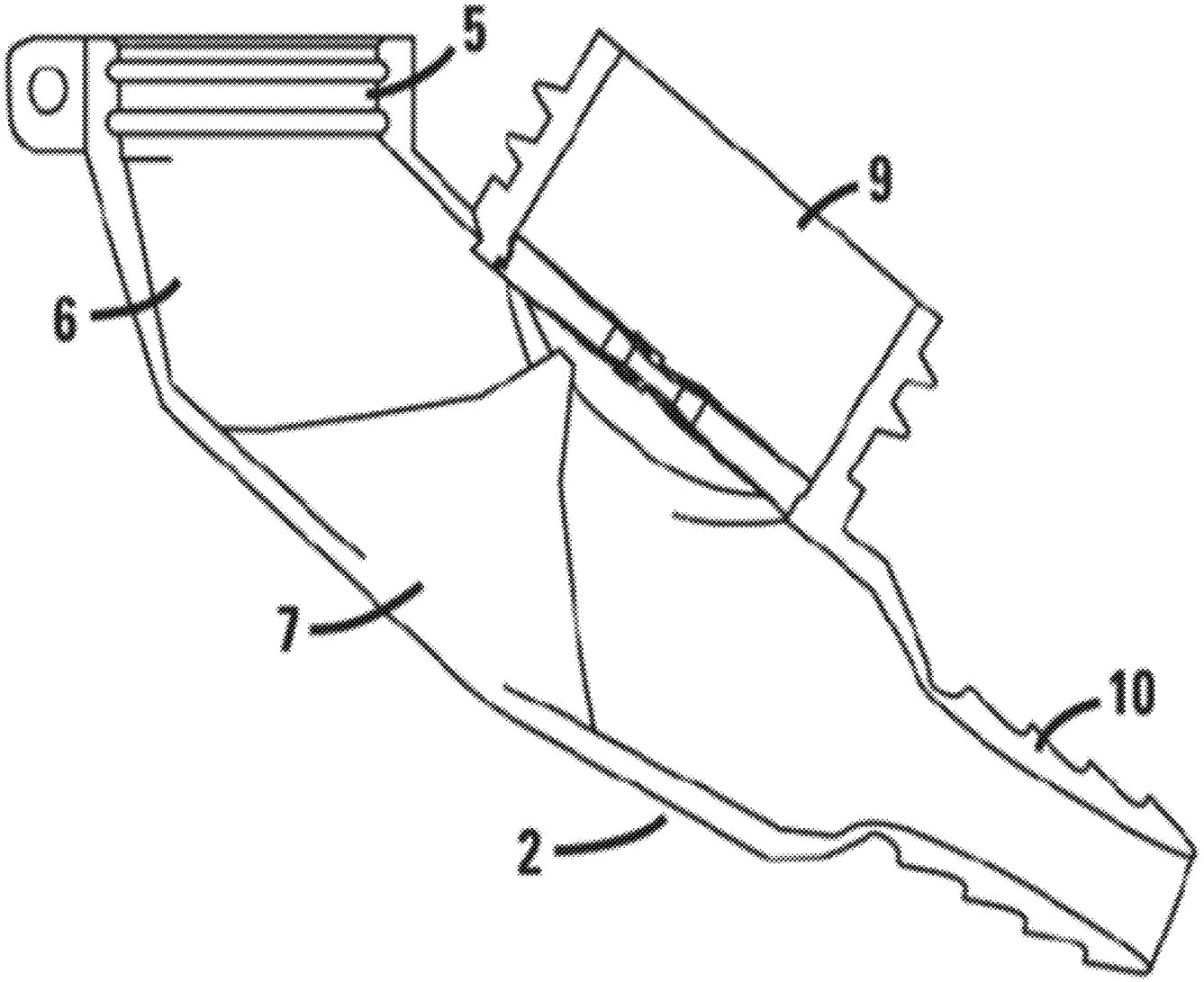
FIG. 12 is a cutaway overview of the internal manifold of the reservoir.

FIG. 12 is a cutaway side view showing the internal manifold of the reservoir 9. This view shows an erosion manifold 6 and turbulence dam 7. In use, water flow exiting the faucet fitting and passing into the internal manifold 4 of the reservoir body 2 has to negotiate a turn caused by the turbulence dam 7. In an example, the turbulence dam 7 may cause a turn of the water flow of about 60 degrees, although other angles could be provided by the turbulence dam 7 or other structure within the reservoir body 2, to achieve the desired result.

In an example, the water may flow through a turbulence dam 7 within the reservoir body 2, where the amount of turbulence is adjusted using fluid management techniques. In an example, turbulence dam 7 causes turbulence of the water flow. The shape of the reservoir 2 and/or the turbulence dam 7 may cause a venturi effect, thus speeding the flow of water through the device 1 and as the water flow exits the device 1 through the hose 11 and as the water flow is discharged into the overflow port 15 of the overflow-to-drain journal of the sink. This turbulence may also result in gradual erosion of a cleaning tablet in the tablet chamber 9.

It is noted that erosion may also occur through oxidation or other chemical reactions (e.g., based on the pH value of the water and on chemicals and impurities dissolved within it). Tablet erosion may also occur due to the mechanical scrubbing action of particulate matter suspended in the water, e.g., as it flows through the device.

Other configurations are also possible. For example, the hollow reservoir bore or internal manifold 4 may include a different arrangement, wherein the water passing through the faucet manifold or intake manifold 5 may flow into an erosion manifold or anti-erosion manifold 6 in the reservoir body 2. Using any combination of surfaces, materials, material thicknesses, coatings, or textures (e.g., ridges, grooves, dimples, or bumps), the erosion manifold 6 may reduce erosion of the overflow vent irrigation device from the water passing through it. This change in surface structure may reduce and/or increase friction (drag) with respect to flowing water.

The water exiting the faucet connection 10 may also be turbulent, or may become turbulent within the reservoir body 2, which may increase drag and decrease overall flow rate through the device, whereas a laminar flow may be desirable for its increased flow rate. Alternatively, the water flow through the device may be laminar, whereas a turbulent flow may be desired to increase cleaning action within the overflow-to-drain journal 16 due to increased random motion of the fluid and any materials dissolved or suspended within it.

Figure 13:
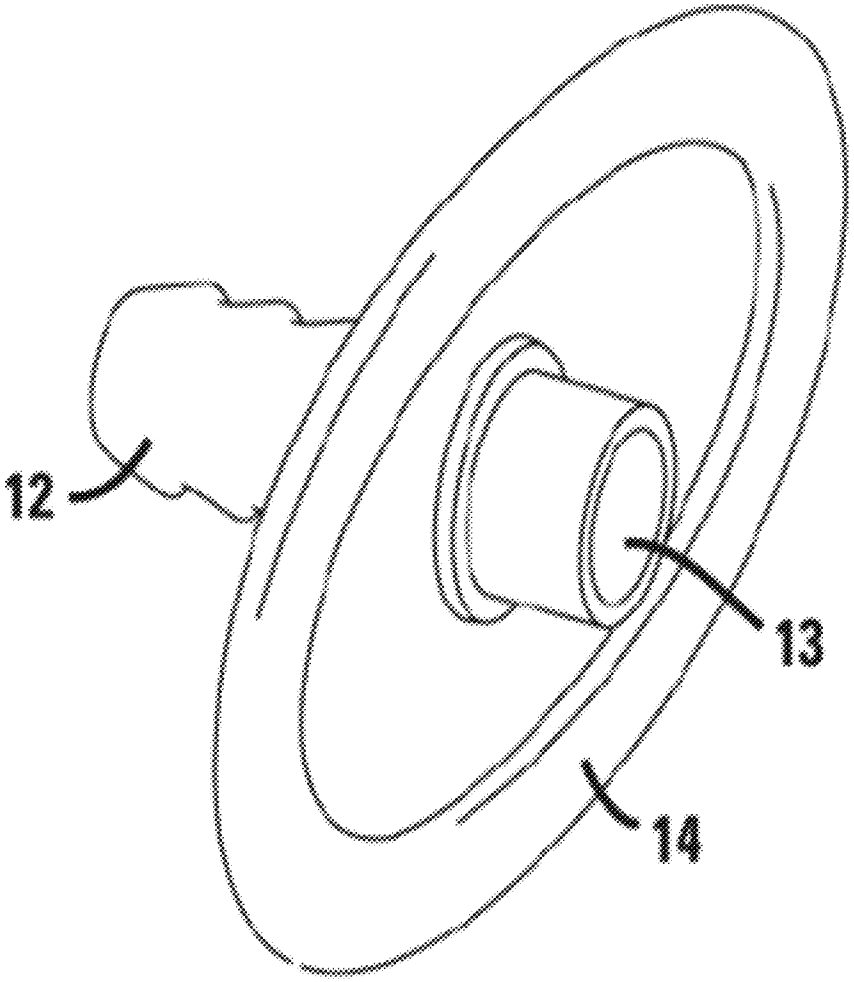
FIG. 13 is an overview of the injection nozzle and splash shield.

FIG. 13 shows the hose fitting 12, injection nozzle 13, and splash shield 14. In an example, the injection nozzle 13 fits into the overflow port 15 of the overflow-to-drain journal of the sink of residential and commercial basins (e.g., sinks). The injection nozzle 13 may be held in place and protected against leakage by the splash guard 14. In an example, the splash guard 14 is held in place and at least partially sealed by adhesives, suction, and/or physical shape, against the sink body and the overflow port 15 of the overflow-to-drain journal of the sink. The water flow enters from the hose 11 through the hose connector 12, and passes through the injection nozzle 13 into the overflow port 15 of the overflow-to-drain journal of the sink. As such, the water flows through the overflow-to-drain journal 16, where it may clean and disinfect surfaces, and then exits to the drain.

Although the figure depicts the faucet and overflow port of the overflow-to-drain journal of the sink as belonging to the same fixture, it should be understood that the water supply may come from one sink or fixture while cleaning the overflow-to-drain journal of a different sink or fixture.

Figure 14:
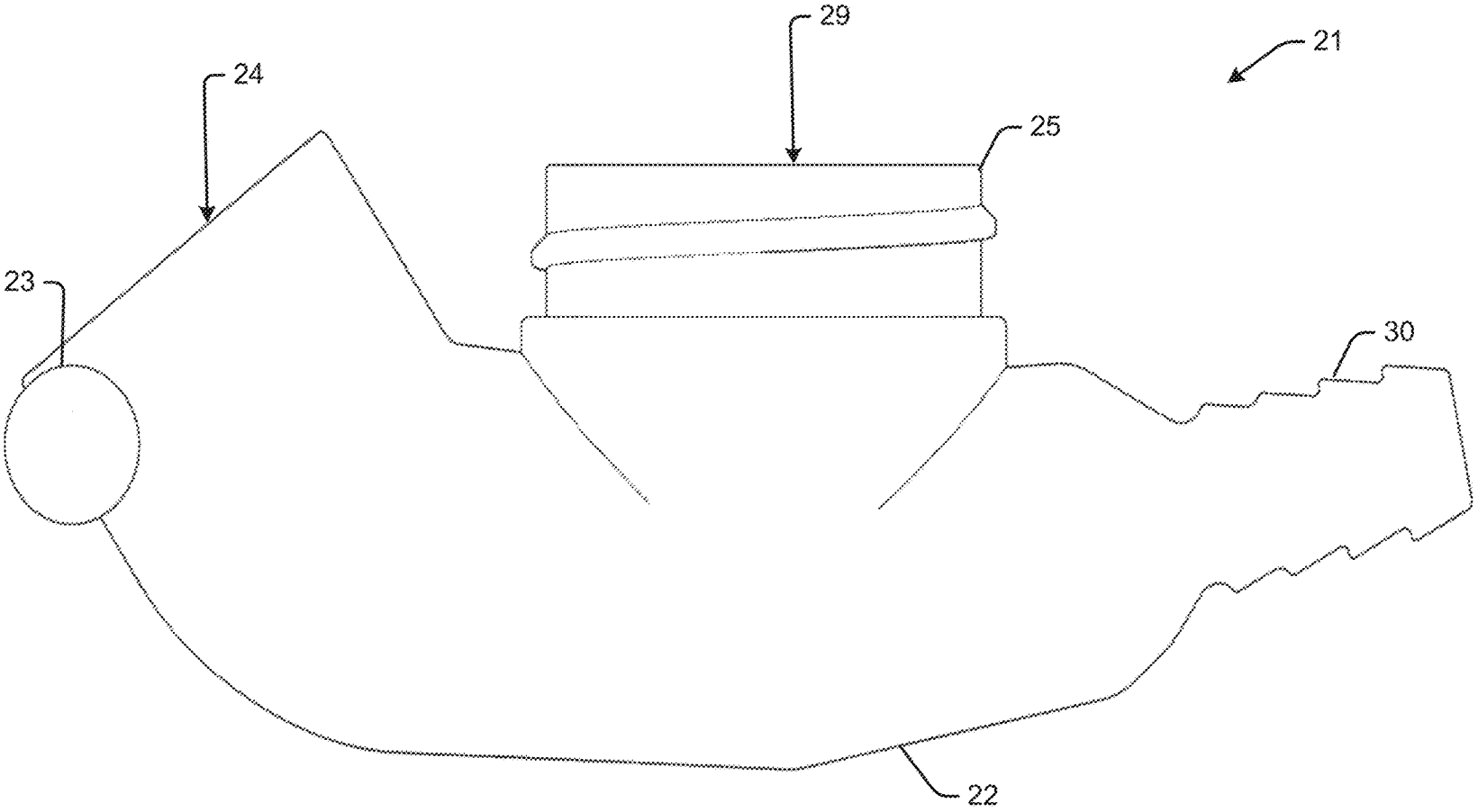
FIG. 14 is a right-side view of another overflow vent irrigation device. The example overflow vent irrigation device has a reservoir.
Figure 15:
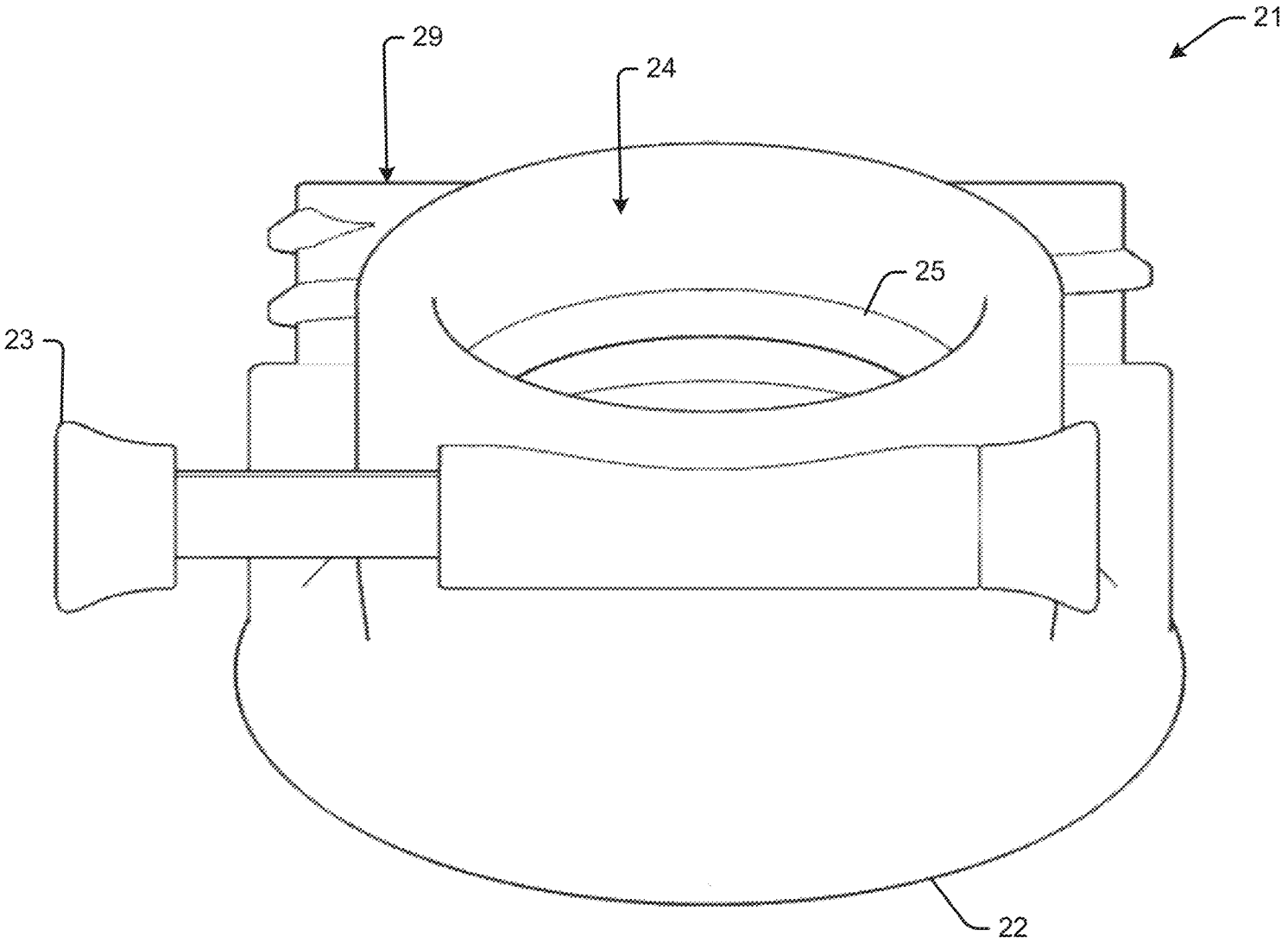
FIG. 15 is a back top view of the example overflow vent irrigation device.
Figure 16:
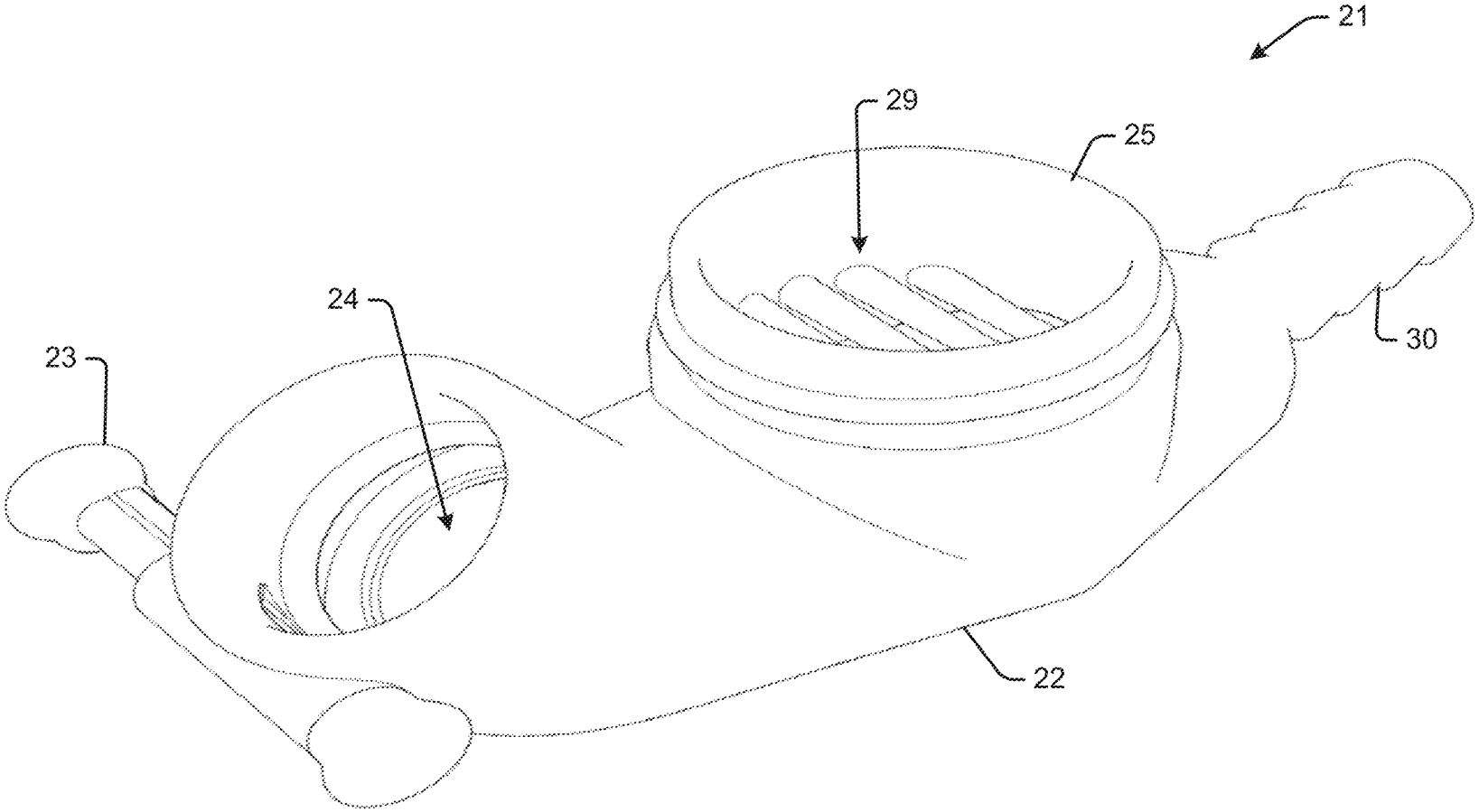
FIG. 16 is a top perspective view of the example overflow vent irrigation device.
Figure 17:
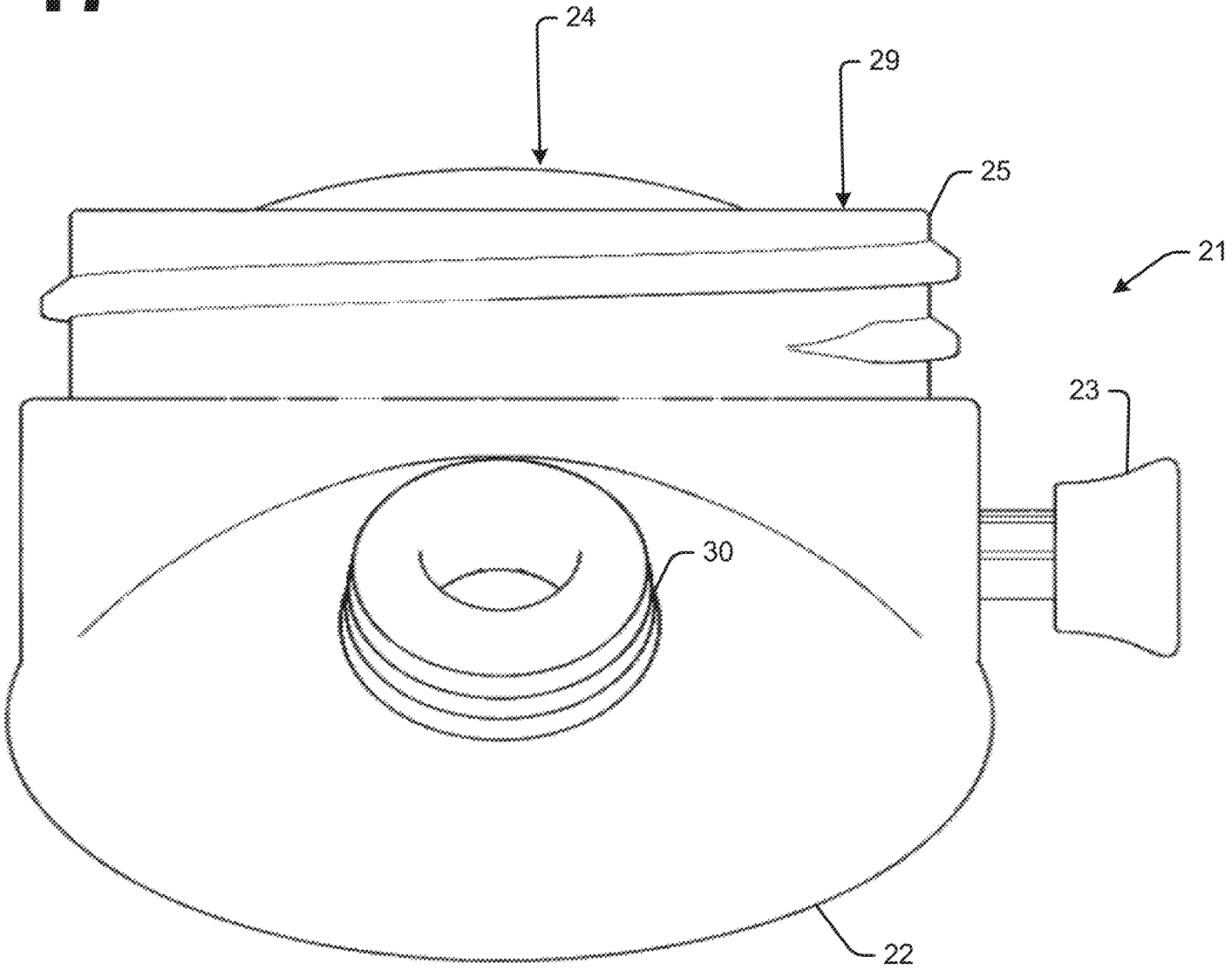
FIG. 17 is a front view of the example reservoir of the overflow vent irrigation device.
Figure 18:
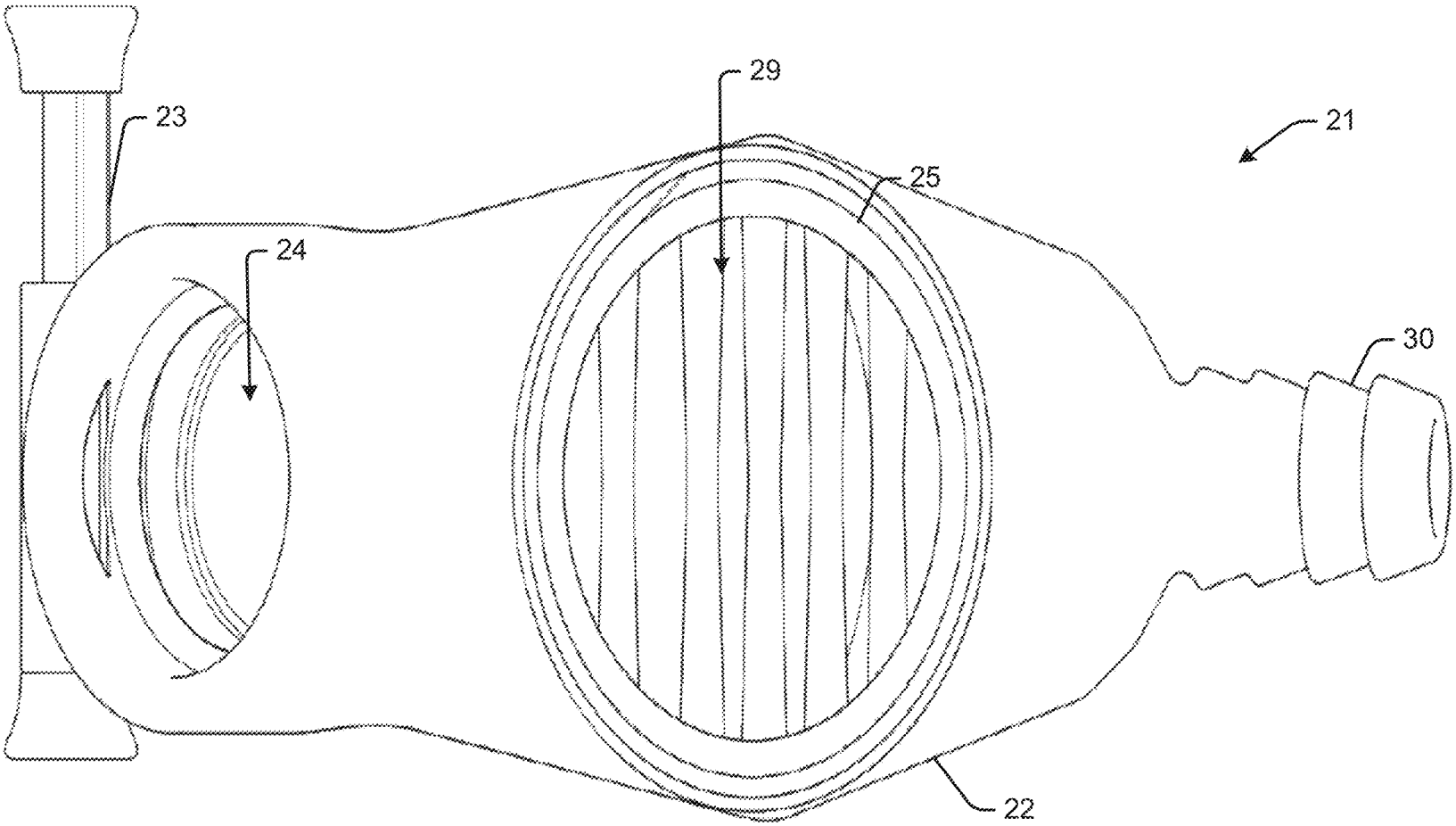
FIG. 18 is a top view of the example reservoir of the overflow vent irrigation device.

FIG. 14 is a right-side view of another overflow vent irrigation device 21. The example overflow vent irrigation device 21 has a reservoir 22. FIG. 15 is a back top view of the example overflow vent irrigation device 21. FIG. 16 is a top perspective view of the example overflow vent irrigation device 21. FIG. 17 is a front view of the example reservoir 22 of the overflow vent irrigation device 21. FIG. 18 is a top view of the example reservoir 22 of the overflow vent irrigation device 21.

The example overflow vent irrigation device 21 is shown without the tablet chamber cap in FIGS. 14-18, although a cap may be provided as shown for the overflow vent irrigation device 21. It is noted that the quick connect latch of the overflow vent irrigation device 21 may include a slide latch or lock pin 23. A bore seal 25 is also shown for the interior manifold or reservoir bore 24.

It is noted that the examples shown and described are provided for purposes of illustration and are not intended to be limiting. Still other examples are also contemplated.

The invention claimed is:

1. An overflow vent irrigation device, comprising:

a body having three separate chambers formed between an input port and an exit port;

an erosion manifold forming a first one of the three separate chambers, the input port opening into a first end of the erosion manifold;

a tablet chamber forming a second of the three separate chambers, the tablet chamber having a cap to open and close an opening of the tablet chamber, a first side of the tablet chamber connecting to a second end of the erosion manifold; and a reservoir forming a third one of the three separate chambers, a first end of the reservoir connected to a second side of the tablet chamber, and a second end of the reservoir connected to the exit port;

a turbulence dam defining a second end of the erosion manifold and the first end of the reservoir within the body, a peak of the turbulence dam formed between the erosion manifold and the reservoir within a width defined by a diameter of the tablet chamber;

wherein during use the input port is connected to a faucet of a basin, and the exit port is connected via a hose to an overflow port of the overflow-to-drain journal of the basin.

2. The overflow vent irrigation device of claim 1, further comprising an injection nozzle and a splash shield to connect the hose to the overflow port of the overflow-to-drain journal of the basin.

3. The overflow vent irrigation device of claim 1, further comprising a cleaning material in the tablet chamber for fluid communication with water in the body before conducting into a hose at the exit port of the reservoir body.

4. The overflow vent irrigation device of claim 1, further comprising a grate to retain a cleaning tablet in the tablet chamber separate from the erosion manifold and the reservoir.

5. The overflow vent irrigation device of claim 1, further comprising a snap fitting to releasably connect the exit port of the body to the hose.

6. The overflow vent irrigation device of claim 5, wherein a quick connect retaining clip secures the body to the faucet.

7. The overflow vent irrigation device of claim 1, further comprising a splash guard configured to seal an injection nozzle against the overflow port of the overflow-to-drain journal of the basin.

8. The overflow vent irrigation device of claim 3, wherein the cleaning material includes cleaning chemicals that become dissolved in the water and/or cleaning solids that become suspended in the water.

9. An overflow vent irrigation device, comprising:

a body having an input port, three separate chambers, and an exit port, wherein the input port is connected to a faucet, and the exit port is connected via a hose to an overflow port of an overflow-to-drain journal of a basin for cleaning the overflow-to-drain journal of the basin;

wherein the three separate chambers comprise an erosion manifold, a tablet chamber, and a reservoir;

wherein the input port opens into a first end of the erosion manifold, a first side of the tablet chamber connects to a second end of the erosion manifold, a first end of the reservoir connects to a second side of the tablet chamber, and a second end of the reservoir connects to the exit port; and a turbulence dam forming a peak defining a second end of the erosion manifold and the first end of the reservoir, the peak positioned between a width defined by the first side of the tablet chamber and the second side of the tablet chamber.

10. The overflow vent irrigation device of claim 9, further comprising a quick connect retaining clip to releasably connect the input port of the reservoir body to the faucet.

11. The overflow vent irrigation device of claim 9, further comprising an injection nozzle and a splash shield to connect the hose to the overflow port of the overflow-to-drain journal of the basin.

12. The overflow vent irrigation system of claim 11, further comprising a splash shield to at least partially seal the injection nozzle against the overflow port of the overflow-to-drain journal of the basin.

13. An overflow vent irrigation system for cleaning an overflow-to-drain journal of a basin, comprising:

a connection to a faucet of the basin;

a body in fluid communication with the connection;

wherein the body has three separate chambers: an erosion manifold, a tablet chamber, and a reservoir;

wherein an input port of the body opens into a first end of the erosion manifold, a first side of the tablet chamber connects to a second end of the erosion manifold, a first end of the reservoir connects to a second side of the tablet chamber, and a second end of the reservoir connects to an exit port of the reservoir; and an injection nozzle;

a turbulence dam having a peak positioned within a width of the tablet chamber, the width defined between the first side of the tablet chamber and the second side of the tablet chamber;

wherein when water is flowing from the faucet of the basin into the body, and the injection nozzle is inserted into an overflow port of an overflow-to-drain journal of the basin, the overflow-to-drain journal is flushed with a cleaning solution.

14. The overflow vent irrigation system of claim 13, further comprising:

a hose connecting the reservoir and the injection nozzle; and a splash guard to seal the injection nozzle against the overflow vent of the basin.

15. The overflow vent irrigation system of claim 13, further comprising:

a quick-connect attachment to the faucet.

* * * * *